United States Patent [19]

Barnett et al.

[11] Patent Number: 4,567,401

[45] Date of Patent: Jan. 28, 1986

[54] WIDE-BAND DISTRIBUTED RF COUPLER

[75] Inventors: Larry R. Barnett, Manassas, Va.; Yue-Ying Lau, Silver Spring, Md.; Kwo R. Chu, Annandale, Va.; Victor L. Granatstein, Silver Spring, Md.

[73] Assignee: The United States of America as represented by the Secretary of the Navy, Washington, D.C.

[21] Appl. No.: 389,132

[22] Filed: Jun. 12, 1982

[51] Int. Cl.[4] ..... H01J 25/38; H01J 25/34

[52] U.S. Cl. ..... 315/5; 315/4; 315/5.43; 315/5.51; 315/3.6; 315/39.3; 333/230

[58] Field of Search ..... 315/4, 5, 5.43, 39.53, 315/39.3, 5.51, 3.6; 333/135, 212, 34, 230; 330/56

[56] References Cited

U.S. PATENT DOCUMENTS

| | | | |
|---|---|---|---|
| 3,274,428 | 9/1966 | Harris | 315/5.43 X |
| 3,527,976 | 9/1970 | Thal, Jr. | 315/3.6 |
| 3,958,189 | 5/1976 | Sprangle et al. | 330/4.3 |
| 4,129,840 | 12/1978 | Mok | 333/230 X |
| 4,224,576 | 9/1980 | Granatstein et al. | 330/4 |
| 4,258,286 | 3/1981 | Kageyama | 315/39.3 X |
| 4,284,922 | 8/1981 | Perring et al. | 315/5.43 X |

FOREIGN PATENT DOCUMENTS

| | | | |
|---|---|---|---|
| 54-97348 | 8/1979 | Japan | 333/135 |
| 710083 | 1/1980 | U.S.S.R. | 315/4 |

OTHER PUBLICATIONS

Hall, "Impedance Matching by Tapered or Stepped Transmission Lines", Microwave Journal, Mar. 1966, pp. 109–114.

Maximum Amplification Band of a CRM Twistron by M. A. Molseev, vol. 20, No. 8, pp. 1218–1223—Aug. 1977.

NRL Memorandum Report 4346 (Dec. 10, 1980) by Y. Y. Lau and K. R. Chu.

Gyrotron Traveling Wave Amplifier: III by Y. Y. Lau and K. R. Chu; International Journal of Infrared and Millimeter Waves, vol. 2, No. 3, 1981.

*Primary Examiner*—David K. Moore

*Assistant Examiner*—Vincent DeLuca

*Attorney, Agent, or Firm*—Robert F. Beers; William T. Ellis

[57] ABSTRACT

A wide-band distributed coupler for coupling rf energy from an input waveguide into a tapered interaction waveguide in a traveling-wave amplifier comprising a plurality of channel filters connecting between the input and interaction waveguides, with each filter coupled to the interaction waveguide at the appropriate cross-sectional position along its tapered length where the interaction waveguide cutoff frequency approximately matches the wave frequency propagated by the filter. Each filter comprises, in one embodiment, a main coaxial cavity tuned to a distinct center frequency, a first simple isolation cavity for coupling rf energy between the input waveguide and the main cavity, and at least one second simple isolation cavity for coupling energy between the main cavity and the tapered interaction waveguide. This coupler is compatible both in bandwidth and geometry with the tapered interaction waveguide.

13 Claims, 7 Drawing Figures

WIDE-BAND DISTRIBUTED RF COUPLER

BACKGROUND OF THE INVENTION

The present invention relates generally to millimeter and submillimeter wave amplifiers, and more particularly, to a traveling wave amplifier with a special wide-band distributed coupler therefor for wide-band operation at high power levels.

Information carrying systems such as radar and communications devices require an amplifier mechanism with substantial instantaneous bandwidth rather than simply an oscillation mechanism. In order to provide wide-band high power operation in traveling wave amplifiers, the use of a tapered interaction waveguide in conjunction with a specially profiled magnetic field has been proposed in Application Ser. No. 389,133, filed June 16, 1984, entitled "Wide-Band Gyrotron Traveling-Wave Amplifier" by Y. Y. Lau, L. R. Barnett, K. R. Chu, and V. H. Granatstein. The gyrotron traveling-wave amplifier disclosed therein comprises a tapered waveguide wherein the cross-section thereof gradually increases from a small first end to a larger second end for propagating electromagnetic energy therein, a magnetron device for generating a beam of relativistic electrons with helical electron motion for application to the small first end of the tapered waveguide to propagate in the axial direction therein, a magnetic circuit for generating a tapered magnetic field within the waveguide in a direction approximately parallel to the axis of the waveguide, and an input coupler for launching an input electromagnetic wave so that it co-propagates with the electron beam in the waveguide.

The above-mentioned waveguide is tapered such that its cutoff frequency varies over a predetermined bandwidth. This device then utilizes a reverse rf injection scheme wherein the electromagnetic wave to be amplified is applied at the large end of the tapered waveguide so that it propagates in the waveguide until its individual frequencies are reflected when they reach the point in the waveguide taper where they approximately match the cutoff frequency of the waveguide. These reflected frequencies then co-propagate with and are amplified by the electron beam. It can be seen that this type of coupling scheme will yield a good rf coupling efficiency into the tapered interaction waveguide.

However, in order to take full advantage of the very broad-band nature of this traveling wave amplifier, improved broad-band input couplers are required with a geometry compatible with the tapered interaction waveguide.

OBJECTS OF THE INVENTION

Thus, it is an object of the present invention to develop an improved broad-band input coupler for a distributed traveling wave amplifier with a tapered interaction waveguide.

It is a further object of the present invention to develop a broad-band input coupler with a geometry which is compatible with the geometry of a distributed gyrotron amplifier.

It is yet a further object of the present invention to develop a broad-band input coupler for a distributed gyrotron amplifier which is highly efficient.

It is yet a further object of the present invention to develop a broad-band input coupler for use generally with electron beam traveling-wave amplifiers.

Other objects, advantages, and novel features of the present invention will become apparent from the detailed description of the invention, which follows the summary.

SUMMARY OF THE INVENTION

Briefly, the present invention comprises an rf wide-band traveling wave amplifier with a special broad-band input coupler including a tapered interaction waveguide wherein the cross-section thereof gradually increases from a small first end to a larger second end for propagating electromagnetic energy therein; an input waveguide for providing electromagnetic waves to be amplified; and a multiplexer type distributed coupler circuit for coupling electromagnetic energy from the input waveguide to the interaction waveguide comprising a plurality of channel frequency filters, with each filter coupled to said interaction waveguide at the appropriate cross-sectional position along the tapered length thereof such that the interaction waveguide cutoff frequency approximately matches the wave frequency propagated by the filter so that electromagnetic energy propagated by the given filter will excite the desired mode of electromagnetic energy to propagate toward the larger second end of the interaction waveguide.

In one embodiment of the present invention, each of the channel frequency filters in the multiplexer distributed coupler circuit includes a cavity tuned to a separate center frequency so that the total bandwidth of the coupler circuit is formed of a plurality of contiguous passbands. Each channel frequency filter in the coupler circuit may comprise a main cavity tuned to a separate center frequency, a first simple isolation cavity with appropriate openings for coupling electromagnetic energy between the input waveguide and this main cavity; and at least one second simple isolation cavity with appropriate openings for coupling electromagnetic energy between the main cavity and the tapered interaction waveguide. In one configuration, this main cavity may be disposed coaxially around the tapered interaction waveguide.

BRIEF DESCRIPTION OF THE DRAWINGS

FIG. 1(*b*) is a perspective view of FIG. 1(*a*) using a rectangular interaction waveguide.

FIG. 5(*b*) is a end view of the channel filter embodiment shown in FIG. 4.

DETAILED DESCRIPTION OF THE PREFERRED EMBODIMENT

Figure 1A:
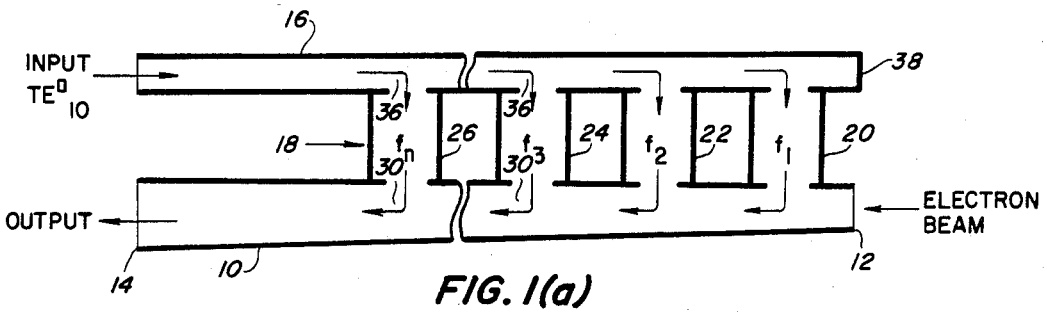
FIG. 1(*a*) is a cross-sectional view of one embodiment of the distributed input coupler in combination with a tapered interaction waveguide.

The present invention is directed to a distributed input coupler in combination with a tapered interaction waveguide for use in traveling-wave electron amplification devices. The present combination will be described in the context of a gyrotron amplifier, which is a fast wave structure, although it should be understood that this combination may be utilized also with slow wave structures with either dielectric or periodic structure loading, or with conventional electron beam amplifiers.

The basic gyrotron traveling-wave amplifier utilizing a tapered interaction waveguide is described in some detail in the aforementioned application by Lau, Barnett, Chu, and Granatstein and in an article entitled "Theory of a Wide-Band Distributed Gyrotron Traveling-Wave Amplifier", by the same authors in IEEE Transactions on Electron Devices, Vol. ED-28, No. 7, July 1981. These two references are hereby incorporated by reference. Amplification in the traveling-wave amplifier described in these references as in other traveling-wave amplifiers, is based on the coherent stimulated emission of radiation from electrons in a traveling-wave structure. In the case of the gyrotron the electron cyclotron maser mechanism is utilized to obtain relativistic azimuthal phase bunching which is discussed at some length in the above-incorporated references. In the gyrotron, the phases of the electrons in their cyclotron orbits are initially random. However, relativistic azimuthal bunching occurs when the electrons with their cyclotron motion interact with rf radiation at appropriate frequencies. The resulting phase bunching from this rotating electron interaction with the rf wave causes the electrons to radiate coherently and amplify the wave.

The basic interaction waveguide referred to in the above-incorporated references comprises a waveguide wall which is tapered from a small end to a larger end. The rationale behind this tapering of the waveguide is that there is a minimum frequency which will propagate in a waveguide of constant cross-section. This minimum frequency or cutoff frequency will change as the cross-section of the waveguide changes. When the frequencies propagate into a portion of the waveguide where those frequencies are less than the minimum frequency, then those frequencies will be reflected such that they propagate axially in the waveguide toward the larger end thereof. By tapering the waveguide, i.e., gradually changing the cross-section thereof, the minimum frequency or cutoff frequency for the waveguide will change. Thus, different frequencies will be reflected from different points along the waveguide structure. Accordingly, an input wave composed of a plurality of frequencies will have its different frequencies reflected at different points along the tapered waveguide as those frequencies reach the various points in the waveguide where they are equal to the waveguide minimum or cutoff frequency. Accordingly, it can be seen that the use of a tapered interaction waveguide will significantly increase the bandwidth of the radiation that can propagate efficiently therein. In the aforementioned application incorporated by reference, an electron gun is utilized to generate a beam of electrons to propagate in the tapered interaction waveguide such that the beam co-propagates with the rf radiation propagating therein. Accordingly, the electron beam is injected into the small end of the interaction waveguide such that it propagates in the axial direction therein with the wall radius of the waveguide increasing in the downstream direction of the beam. The tapered interaction waveguide, and/or the entire system including the electron gun may be disposed inside a magnetic circuit for generating a magnetic field within the tapered waveguide. When the magnetic field generated by the magnetic circuit is properly profiled relative to the waveguide, wide-band amplification of the rf radiation via coherent electron stimulated emissions will occur.

It can be seen from the above, that the proper wide-band operation of the amplifier will depend, in large measure, on the efficient coupling of wide-band rf energy into the tapered interaction waveguide. The present invention is directed to such a coupling structure in combination with the tapered interaction waveguide.

Figure 1B:
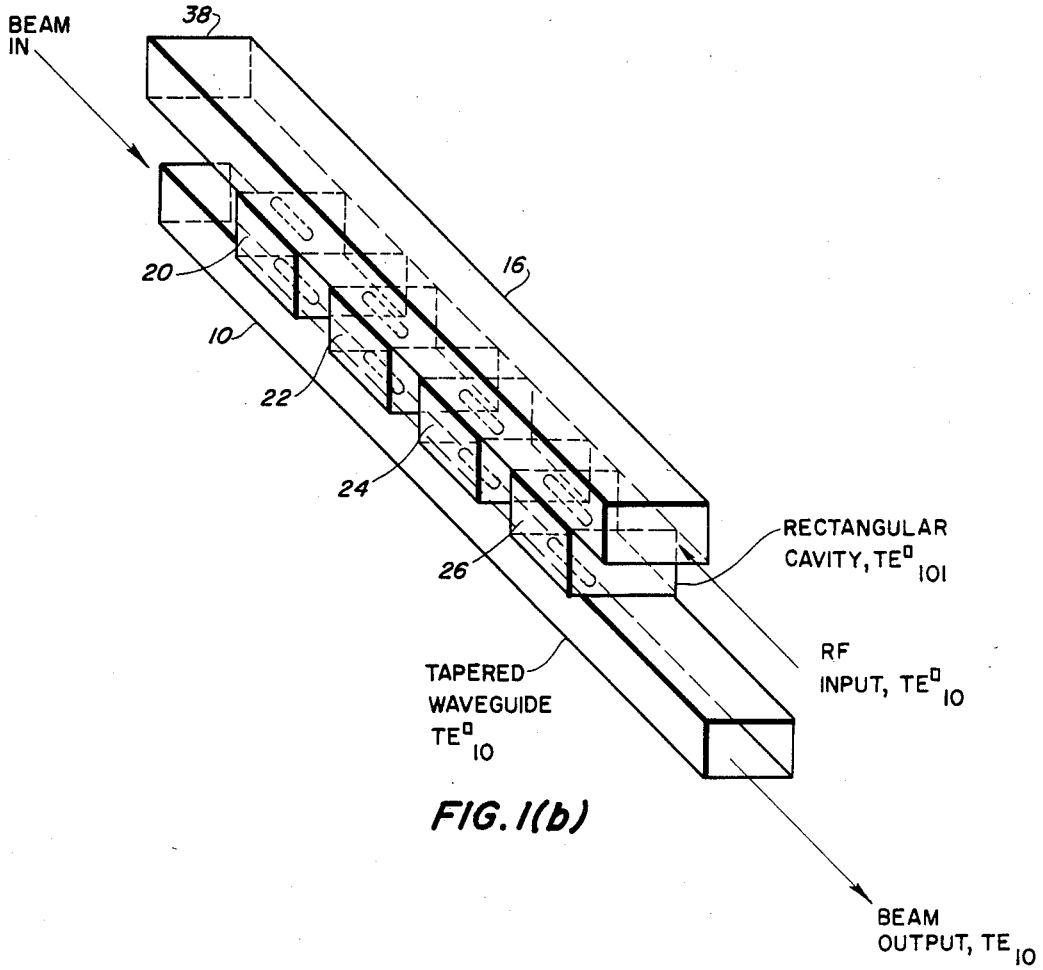

Referring now to the drawings, wherein like reference characters designate like or corresponding parts throughout the views, FIG. 1 shows the basic distributed input coupler of the present invention in combination with a tapered interaction waveguide operating in the fundamental $TE_{11}$ circular waveguide mode or the $TE_{1O}$ rectangular waveguide mode. The tapered interaction waveguide is designated 10 and has a gradual cross-sectional tapering from a small end 12 to a larger end 14. An electron beam is injected axially into the interaction waveguide at the small end 12. This waveguide 10 may take a variety of cross-sectional shapes such as oval, circular, rectangular, square, etc., and may operate in a variety of waveguide modes. For convenience, the waveguide 10 actually constructed will be circular in cross-section.

An input waveguide 16 is utilized for providing electromagnetic waves to be amplified. A multiplexer distributed coupler circuit 18 is utilized for coupling electromagnetic energy from the input waveguide 16 to the tapered interaction waveguide 10. This distributed multiplexer coupler circuit 18 comprises a plurality of channel frequency filters 20, 22, 24, and 26. The channel filters 20, 22, 24 and 26 are tuned to separate center frequencies $f_1$, $f_2$, $f_3$, and $f_n$, respectively, in order to separate out individual bands or channels centered around those frequencies from the input waveguide 16. These separated-out signal bands or channels are then injected at the appropriate cross-sectional position along the tapered interaction waveguide 10 such that the interaction waveguide cutoff frequency at those points approximately matches the wave-center frequency propagated by the individual channel filters.

In one embodiment shown in FIG. 1(*b*) these channel filters may comprise simple rectangular cavities for transferring energy between a rectangular input waveguide and a rectangular tapered waveguide 10.

Figure 2:
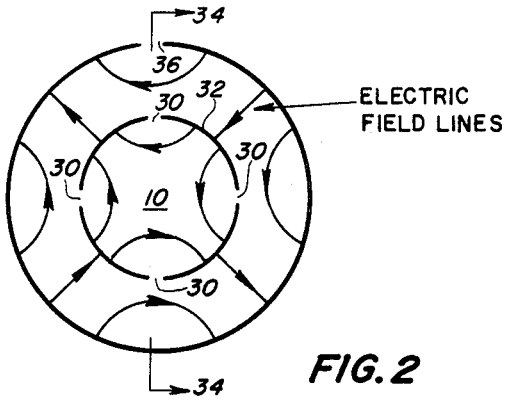
FIG. 2 is a cross-sectional view of a co-axial coupling cavity.

In another embodiment, these channel filters 20, 22, 4 and 26 may comprise co axial cavities excited in a mode which will couple through apertures 30 in the inner surface of the co-axial cavity to excite the desired mode in the tapered waveguide 10. A cross-sectional view of such a coaxial cavity is shown in FIG. 2. Four apertures 30 are shown on the inner surface 32 of the co-axial cavities for coupling into the tapered interaction waveguide 10. The opening or slot 36 is utilized to couple between the input waveguide 16 and the outer surface of the co-axial cavity. For efficient transmission through the co-axial cavity channel filters, the input and output coupling should be tight so that the loaded Q(with apertures) is much less than the unloaded Q(no coupling apertures). The loaded Q will depend on the channel bandwidth desired and may be varied by adjusting the coupling factor for the coupling apertures.

As noted above, the co-axial cavities are tuned to separate frequencies. Since the present application requires a multiplexer with contiguous passbands (i.e., no guard bands) the filter center frequencies are chosen so that the filter responses crossover at the 3-dB points of the filters. Accordingly, adjacent cavities will strongly couple near their crossover frequency. These co-axial cavities may be tuned by a variety of methods well known in the art. This tuning generally consists of varying the volume of the cavity in some well known manner to change the frequencies which will resonate therein. By way of example, a tuning screw could be utilized to change the volume of the cavity and thus the resonant frequency thereof.

In order to couple the maximum amount of energy in a particular frequency band from the input waveguide 16 through the appropriate channel filter to the tapered interaction waveguide 10, the input slots 36 from the input waveguide 16 into the channel filters are located an odd number of quarter wavelengths of the respective cavity from a short 38 in the input waveguide 16. When the slot aperture for a given cavity is located a quarter or an odd number of quarter wavelengths (ie, $\frac{1}{4}$, $\frac{3}{4}$, etc., of the respective cavity) from the short 38, the reflection from the short will create a standing wave pattern, with a maximum in the standing wave at locations which are an odd number of quarter wavelengths from the short. Accordingly, this positioning of the channel filter coupling slots increases the electric field strength at each slot aperture, thereby increasing the coupling through the aperture for its particular frequency band. In essence, the resonant cavity located an odd number of quarter wavelengths from a short acts as a shunt impedance to the input waveguide. Cavities which are non-resonant at that frequency appears as open circuits and do not couple at that frequency.

As noted above, the channel filters are coupled into the interaction waveguide at the appropriate cross-sectional position thereof where the interaction waveguide frequency approximately matches the wave frequency propagated by the channel filter. Thus, each channel filter is distributed along and coupled to the tapered waveguide 10 at a different point there along. In general, the tapered interaction waveguide 10 will be designed to operate efficiently only in one energy mode. Accordingly, the channel filters must be designed to operate in a corresponding cavity mode which will setup the desired mode in the interaction waveguide. By way of example, for a full coaxial cavity, proper filter design may be effected by utilizing the following design equation:

$$\lambda = 2\left[\left(\frac{2X_{mn}}{\pi a}\right)^2 + \left(\frac{1}{L}\right)^2\right]^{\frac{1}{2}}$$

where m, n, and 1 correspond to the $TE_{n,m,1}$ modes, L is the length of the cavity, and a is the outer diameter of the coaxial cavity. Plots of the values $x_{m,n}$ for a number of low-order modes as a function of the ratio of the wall radii are set out in the article "Some Results on Cylindrical Cavity Resonators," by J. P. Kinzer and I. G. Wilson, Bell Systems Technology Journal, Vol. 26, pages 410–445, 1947.

A variety of coaxial cavity geometrics are available for use in the filter design. In this case the coaxial cavity shown in FIG. 2 is a $TE_{211}$ coaxial cavity and is designed for a tapered interaction waveguide which propagates a $TE_{21}$ mode. The $TE_{21}$ mode is the optimum mode for operating a gyrotron traveling wave amplifier at the second cyclotron harmonic. (See the paper by Chu et al., noted above.) For this propagation mode, four azimuthal current maximums exist on the inner wall 32 of the interaction waveguide 10 shown in the FIG. 2. Therefore, four axial slot apertures 30 in the inner wall are used to strongly couple to the $TE_{21}$ mode in the interaction waveguide inside the coaxial cavity. Utilizing this coaxial cavity with the four axial slot apertures 30 as shown in FIG. 2, mode selectivity is good.

It is of course understood, that any of the lower modes can be excited by a coaxial cavity operating in the corresponding mode, i.e., a $TE_{111}$ will couple to a $TE_{11}$, a $TE_{011}$ will couple to a $TE_{01}$, etc. In this case in particular, it should be noted that a $TE_{011}$ will couple to not only a $TE_{01}$, but also to a $TE_{21}$ if only two opposing coupling slots are used. Accordingly, it can be seen that the proper number and location of the axial slots is required in order to effect the proper coupling into the interaction waveguide 10 in order to excite the propagation of the desired energy modes. In general, the number and location of aperture slots is determined simply by a knowledge of the electric field configuration of the desired mode and the wall currents that are set up in the cavity. Design principles in this regard are discussed in the reference *Microwave Engineer Handbook,* A. F. Harvey, 1963, Academic Press.

Although the lower order coaxial cavity modes are fairly wide-spaced, wide band-width amplifier designs tend to cross spurious resonances. In general, the lowest resonant frequency in a cavity will be where a half wavelength will fit in two dimensions in the cavity. As the frequency increases, eventually the wavelength of the frequency will be such that two half wavelengths will be able to fit in two dimensions. This is the next resonant frequency for the cavity. The separation in frequency between the lower resonant frequencies for a coaxial cavity is typically 10–15%. However, if by way of example, the band-width desired is a 20% bandwidth, then two resonant frequencies will be present in the bandwidth for that particular coaxial cavity. Both of these resonant frequencies will couple through to the tapered interaction waveguide 10. However, the higher order mode will not excite the tapered waveguide in the mode desired. In this regard, various techniques are known for minimizing such spurious mode interference. These techniques comprise, by way of example, the proper positioning and shaping of coupling apertures to minimize coupling to the spurious modes. The loading of the spurious modes may be accomplished, by way of example, by putting microwave absorber material in locations that will absorb spurious modes but will not affect the desired mode, the use of fins to destroy the mode structure and hence, the resonant frequency in the spurious mode, etc.

Figure 3:
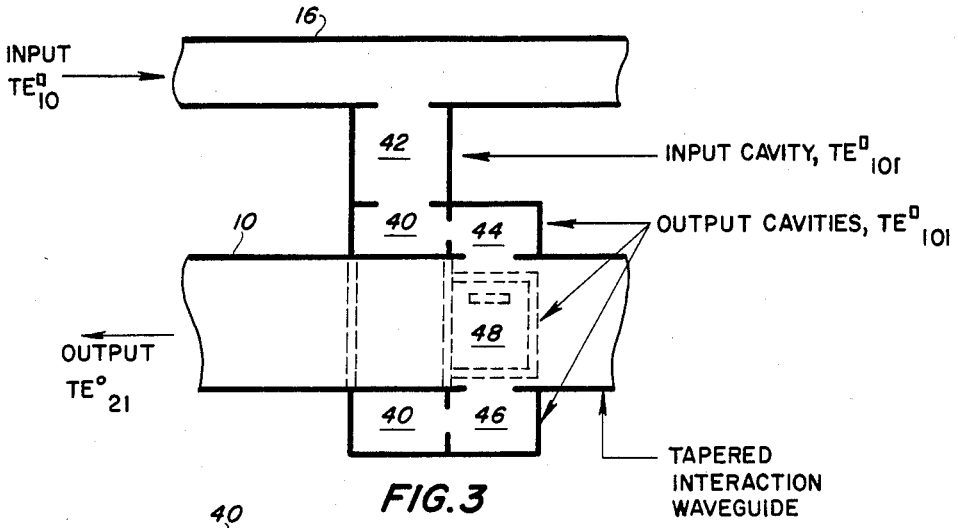
FIG. 3 is a cross-sectional view of a second channel filter embodiment.
Figure 4:
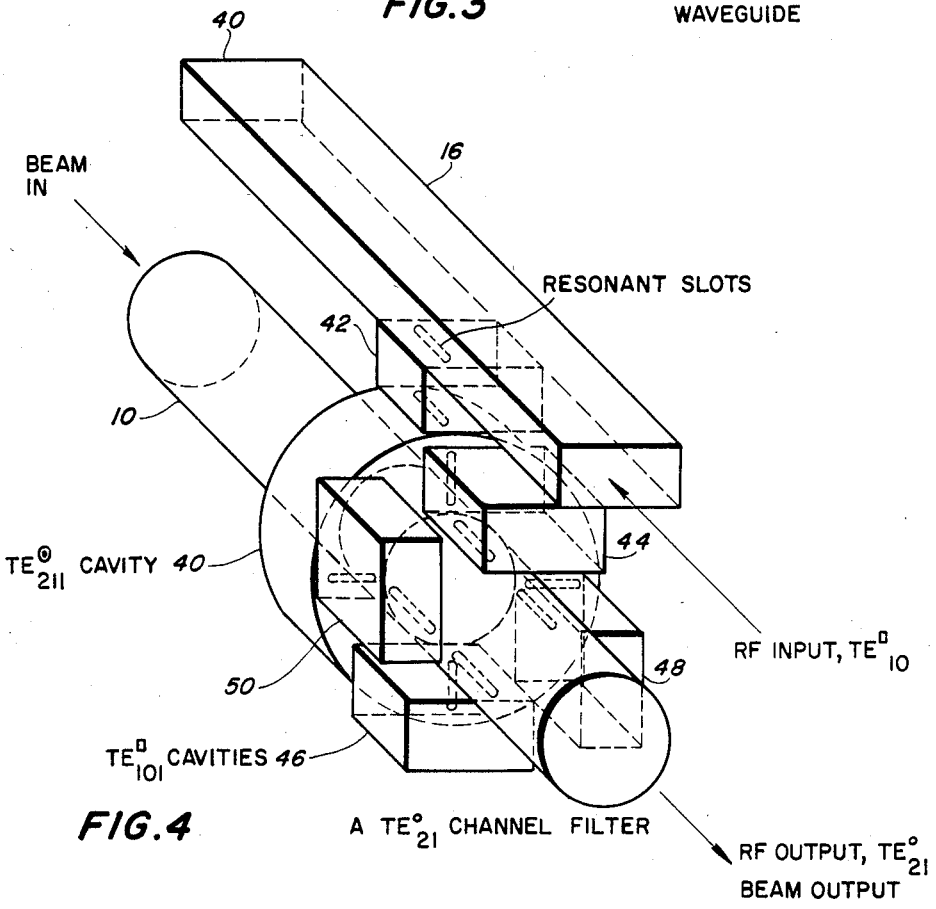
FIG. 4 is a perspective view of the channel filter embodiment shown in FIG. 3.
Figure 5A:
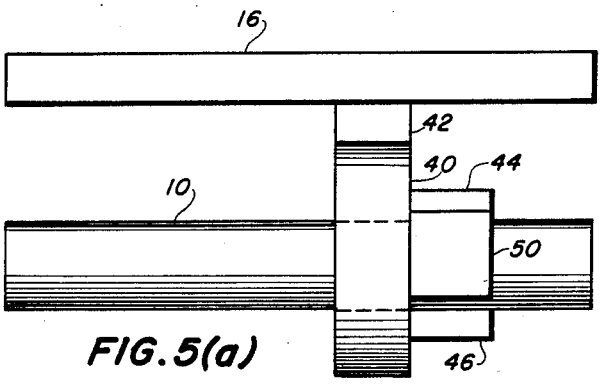
FIG. 5(*a*) is a side view of the channel filter embodiment shown in FIG. 4.
Figure 5B:
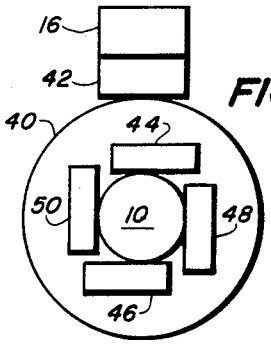

In a preferred embodiment, instead of using a single coaxial cavity as the filter element between the input and interaction waveguides, several coupled cavities in tandem may be utilized to suppress spurious modes. Structure utilizing a plurality of coupled cavities in tandem as the channel filter is shown in FIG. 3. In this case, a coaxial cavity 40 is disposed concentric with the tapered interaction waveguide 10. The input electromagnetic waves at a particular frequency or frequency band are coupled from the input waveguide to the coaxial cavity 40 via a simple isolation cavity 42. The coaxial cavity 40 would then be coupled to the interaction waveguide 10 not directly by means of slot apertures, but via a second simple isolation cavity 44 by means of appropriate slot apertures. These cavities 42 and 44 preceding and following the coaxial cavity 40, are designed to have spurious modes outside the amplifier band of interest, and therefore, act to isolate the coaxial cavity from the input and interaction waveguides. A variety of simple cavity shapes may be utilized as isolation cavities in the present invention. However, rectangular cavities have been utilized as the cavities 42 and 44 in FIG. 3 because they have the simplest mode structure. Simple rectangular cavities are advantageous because they have a wide frequency separation between their resonant frequencies, as compared to other cavity configurations. Thus, such simple rectangular cavities will not propagate or couple the higher undesirable resonance frequencies of the coaxial cavity 40. In the present configuration shown in FIG. 3, the perspective view in FIG. 4, and the side and end views in FIGS. 5(*a*) and 5(*b*), four separate rectangular cavities 44, 46, 48 and 50 are utilized to couple the energy from the coaxial cavity 40 to the tapered interaction waveguide 10. The four simple isolation cavities 44, 46, 48 and 50 are utilized to couple energy from four separate slots in the coaxial waveguide 40 in order to prevent the coupling of undesired modes. With appropriate coupling and stagger tuning of the various cavities, these channel filters can be made with a much better passband response than the simple single cavity filter. Moreover, additional cavities can be coupled in tandem such that a rectangular bandwidth response is approached.

It should be understood, that although the present invention has been disclosed in the context of an interaction waveguide for propagating the $TE_{11}$ and the $TE_{21}$ modes, the present invention is not limited thereto. In particular, a wide variety of modes could be utilized merely by changing the tapered waveguide, and/or the cavity and slot configurations in the device. The mode choice will generally depend on the operating frequency, cyclotron harmonic, the power requirements of the application, and other particular requirements for the system.

It should further be understood, that although a coaxial cavity has been utilized in the present design as the preferred channel-filter main-cavity embodiment, there are other cavity configurations which could be utilized.

In essence, the present invention comprises a distributed input coupler involving multi-cavity coupling between an input waveguide and a tapered interaction waveguide. In one embodiment, this coupler comprises a plurality of channel filters distributed along the length of the waveguide, with each channel filter comprising several coupled cavities in tandem for suppressing spurious modes. This distributed input coupler is compatible both in bandwidth and geometry with the wideband tapered gyrotron traveling wave amplifier and more generally with any other traveling wave amplifier configuration utilizing a tapered interaction waveguide.

Obviously many modifications and variations of the present invention are possible in light of the above teachings. It is therefore to be understood that within the scope of the appended claims the invention may be practiced otherwise than as specifically described.

What is claimed to be secured and desired by Letters Patent of the United States is:

1. An rf traveling-wave amplifier including:

a tapered interaction waveguide wherein the cross-section thereof gradually increases from a small first end thereof to a larger second end for propagating electromagnetic energy in a broad frequency band therein;

an input waveguide disposed external to said interaction waveguide for providing electromagnetic waves to be amplified;

a multiplexer distributed coupler circuit disposed external to said interaction waveguide for coupling electromagnetic energy from said input waveguide to said interaction waveguide comprising a plurality of channel frequency filters disposed outside said interaction waveguide, with each filter tuned to a different frequency passband, with each filter coupled to said interaction waveguide at a different appropriate cross-sectional position along the tapered length thereof such that the interaction waveguide cutoff frequency at that position approximately matches the wave frequency propagated by said filter so that electromagnetic energy propagated by the given filter will excite the desired mode of electromagnetic energy to propagate toward said larger second end of said interaction waveguide.

2. An rf traveling wave amplifier as defined in claim 1, wherein each of said channel frequency filters in said muliplexer distributed coupler circuit includes a cavity tuned to a different separate center frequency so that the bandwidth of said coupler circuit is formed of contiguous passbands; and wherein said each channel frequency filter is coupled to said input waveguide at a different longitudinal point along the length of said input waveguide.

3. An rf traveling wave amplifier as defined in claim 2, wherein said input waveguide has a first end for the launching of the electromagnetic energy to be amplified therein, and a second end which is short circuited; and wherein said cavities are coupled to said input waveguide by openings therein located an odd number of quarter wavelengths of each cavity's tuned frequency from said short in said input waveguide.

4. An rf traveling wave amplifier as defined in claim 2, wherein each cavity for each of said channel frequency filters are coaxial with said tapered interaction waveguide and couple thereto via one or more openings in the interaction waveguide.

5. An rf traveling-wave amplifier as defined in claim 2, wherein said each channel frequency filter in said coupler circuit comprises:

a main cavity tuned to a separate center frequency so that the said coupler circuit has an approximately continuous bandwidth formed from contiguous passbands;

a first simple isolation cavity with appropriate openings for coupling electromagnetic energy between said input waveguide and said main cavity; and at least one second simple isolation cavity with appropriate openings for coupling electromagnetic energy between said main cavity and said tapered interaction waveguide.

6. An rf traveling-wave amplifier as defined in claim 5, wherein said main cavity is disposed coaxially around said tapered interaction waveguide.

7. An rf traveling-wave amplifier as defined in claim 6, wherein said first simple isolation cavity and said at least one second simple isolation cavity are rectangular cavities.

8. An rf traveling-wave amplifier as defined in claim 7, wherein the electromagnetic wave propagated in said input waveguide has a $TE_{10}$ mode, the mode set up in said coaxial main cavity is a $TE_{211}$ mode, and said one second simple isolation cavity comprises four rectangular cavities disposed around the circumference of said interaction waveguide at the appropriate cross-sectional position thereof with openings for coupling the $TE_{211}$ mode from said main cavity into said interaction waveguide in order to excite a $TE_{21}$ mode therein.

9. An rf traveling wave amplifier as defined in claim 6 or 8, wherein said input waveguide has a first end for the launching of the electromagnetic energy to be amplified therein, and a second end which is short circuited; and wherein the first isolation cavity for each channel filter is coupled to said input waveguide an odd number of quarter wavelengths of that cavity's tuned frequency from said short in said input waveguide.

10. A wide-band contiguous multiplexing coupler for coupling electromagnetic energy from an input waveguide to propagate in a tapered interaction waveguide in a traveling wave amplifier comprising:

a plurality of channel frequency filters, each tuned to a different frequency passband, connecting between the input and interaction waveguides, with each filter coupled to said input waveguide at a different longitudinal point along the length of said input waveguide and coupled to said interaction waveguide at a different appropriate cross-sectional position along the tapered length thereof where the interaction waveguide cutoff frequency at that position approximately matches the wave frequency propagated by said filter, and wherein each channel filter comprises;

a main cavity tuned to a separate center frequency so as to form with the other channel filters a plurality of approximately contiguous passbands;

a first simple isolation cavity for coupling electromagnetic energy from said input waveguide to said main cavity; and at least one second simple isolation cavity for coupling electromagnetic energy from said main cavity to said tapered interaction waveguide.

11. A contiguous multiplexing coupler as defined in claim 10, wherein said main cavity is disposed coaxially around said interaction waveguide.

12. A contiguous multiplexing coupler as defined in claim 11, wherein said first simple isolation cavity and said at least one second simple isolation cavity are small rectangular cavities.

13. A contiguous multiplexing coupler as defined in claim 12, wherein said at least one second simple isolation cavity comprises four rectangular cavities coupled to said interaction waveguide at the appropriate cross-sectional position thereof for coupling electromagnetic energy from said main cavity to said interaction waveguide.

* * * * *